US009072324B2

(12) United States Patent
Zamponi

(10) Patent No.: US 9,072,324 B2
(45) Date of Patent: Jul. 7, 2015

(54) MOTORCYCLE GARMENT AND RELEVANT FLAP

(75) Inventor: Simone Zamponi, Corridonia (IT)

(73) Assignee: PELLETTERIA ARISTON S.R.L., Macerata (MC) (IT)

( * ) Notice: Subject to any disclaimer, the term of this patent is extended or adjusted under 35 U.S.C. 154(b) by 99 days.

(21) Appl. No.: 13/877,564

(22) PCT Filed: Oct. 17, 2011

(86) PCT No.: PCT/EP2011/068131

§ 371 (c)(1),
(2), (4) Date: Apr. 3, 2013

(87) PCT Pub. No.: WO2012/052413

PCT Pub. Date: Apr. 26, 2012

(65) Prior Publication Data

US 2013/0239284 A1 Sep. 19, 2013

(30) Foreign Application Priority Data

Oct. 18, 2010 (IT) ..... MC2010A0103
Feb. 7, 2011 (IT) ..... MC2011A0009

(51) Int. Cl.

| | |
|---|---|
| ***A41D 13/00*** | (2006.01) |
| ***A41D 13/015*** | (2006.01) |
| ***A41D 13/05*** | (2006.01) |
| ***A43B 3/00*** | (2006.01) |
| ***A43B 5/14*** | (2006.01) |

(52) U.S. Cl.

CPC ..... *A41D 13/0015* (2013.01); *A41D 13/00* (2013.01); *A41D 13/0156* (2013.01); *A41D 13/0543* (2013.01); *A41D 2400/80* (2013.01); *A41D 2600/102* (2013.01); *A43B 3/0036* (2013.01); *A43B 5/145* (2013.01)

(58) Field of Classification Search

CPC ..... A41D 13/00; A41D 13/0015; A41D 13/0156; A41D 13/0543; A41D 2400/80; A41D 2600/102; A43B 3/0036; A43B 5/145
USPC ..... 2/22, 23, 79; 441/60; 482/111
See application file for complete search history.

(56) References Cited

U.S. PATENT DOCUMENTS

| | | | | |
|---|---|---|---|---|
| 805,672 | A * | 11/1905 | Samms | 441/60 |
| 1,128,682 | A * | 2/1915 | Homewood | 441/59 |
| 5,371,903 | A | 12/1994 | Lew | |

(Continued)

FOREIGN PATENT DOCUMENTS

| | | | |
|---|---|---|---|
| EP | 1625800 | A2 | 2/2006 |
| JP | 3137204 | A | 6/1991 |

(Continued)

OTHER PUBLICATIONS

International Search Report for corresponding International Application No. PCT/EP2011/068131.

*Primary Examiner* — Anna Kinsaul
(74) *Attorney, Agent, or Firm* — Egbert Law Offices, PLLC

(57) ABSTRACT

A motorcycle garment includes at least a leg guard adapted to cover at least partially one of the driver's legs. At least a flap is disposed on said leg guard in correspondence of the driver's lower half-leg. The flap projects from the driver's lower half-leg towards the motorcycle, in such a way to increase resistance with air flow and increase aerodynamic load of motorcycle when driver moves his lea away from the motorcycle to make curving easier.

11 Claims, 3 Drawing Sheets

(56) References Cited

U.S. PATENT DOCUMENTS

| | | | | |
|---|---|---|---|---|
| 6,305,031 | B1 * | 10/2001 | White | 2/455 |
| 8,127,369 | B2 * | 3/2012 | Bigalke | 2/62 |
| 8,256,022 | B2 * | 9/2012 | Bigalke | 2/62 |
| 2005/0108800 | A1 * | 5/2005 | White | 2/2.5 |
| 2010/0205724 | A1 * | 8/2010 | Kamradt | 2/459 |

FOREIGN PATENT DOCUMENTS

| | | | |
|---|---|---|---|
| JP | 10140407 | A | 5/1998 |
| WO | 2009015686 | A1 | 2/2009 |
| WO | 2012052413 | A1 | 4/2012 |

* cited by examiner

MOTORCYCLE GARMENT AND RELEVANT FLAP

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to a device for motorcycle suits or alternatively for motorcycle boots, as well as to a suit and a boot respectively provided with said device.

2. Description of Related Art Including Information Disclosed Under 37 CFR 1.97 and 37 CFR 1.98.

To better understand the advantages of the invention, which is a revolutionary novelty in the motorcycle sector, it is necessary to explain in detail the various braking techniques that have progressed throughout the years in motorcycling, both at amateur and professional level.

Regardless of the type of motorcycle, one of the most delicate operations for drivers is when they enter a curve. Considering that in competitive motorcycle races it is important to cover a lap of the track in the lowest time possible, it appears evident that the good results of a driver basically depends on the time needed to cover each curve of the track. The route covered in a curve is basically composed of a first part consisting in braking and a second part where drivers progressively start to accelerate.

As mentioned above, there are two types of braking techniques, the first one being typical of street motorcycles in which both driver's feet remain on the foot rests of the motorcycle, whereas the second, which is very much used in cross-country and supermotard racing, provides that the driver's leg facing the inside of the curve is raised from the foot rest and extended forward. The purpose of said second technique is to move the driver's center of gravity forward and towards the side where the motorcycle is going to bend. As shown in FIG. 1, by opening a leg (G) laterally, the resistance offered by the air (F) on the leg determines the creation of a torque M that makes it easier for the driver to bend the motorcycle in such a way to direct it towards the curve to be covered.

Obviously, the higher the speed of the maneuver, the higher will be the benefit for the driver. In fact, it must be noted that, because of the gyroscopic effect of the wheels and inertia of the motorcycle, upon increasing the speed of the motorcycle, also the force necessary for the driver to change the direction of the motorcycle will increase.

Moreover, it must be noted that the higher the opening of the leg, the higher the torque (M) will be, thus making the motorcycle bend more rapidly. In view of the above, by opening the so-called internal leg, that is the one facing the curve to cover, the driver can change direction more rapidly. In other words, such a technique allows for entering the curve more rapidly, retarding braking, because of air resistance that generates torques contributing to bending the motorcycle.

US2010/096029 illustrates an air flap adapted to be disposed in correspondence of the knee to divert the air flow raising from below on the driver's body.

US2008/222765 discloses a leg protection apparatus for motorcycle drivers, provided with flap surrounding the front external part of the leg in order to convey heat and protect the leg from the external side.

US2004/244087 discloses a motorcycle jacket provided with flap insert situated at the height of the chest to divert an air flow directed towards the driver's face.

EP1625800 discloses a motorcycle suit provided with a plurality of flap inserts collaborating to reduce the air flow transversal to the motion of the motorcycle. Inserts are disposed in such a way to close the space between arms, legs and trunk and the space between the driver's thighs and calves. If the driver moves his leg outwards, said flaps are disposed transversally to the air flow without changing the aerodynamic load.

GB2467977 discloses a motorcycle suit provided with aerodynamic insert shaped as a "hump" that is inflatable and provided with valves for emergency deflating in order to stabilize the neck rapidly in case of accident.

GB2363969 discloses a motorcycle boot provided with anti-wear protections amovably coupled with the boot by means of Velcro. Evidently, sais protections are applied of the side of the boot adapted to come in contact with the ground, therefore in correspondence of the external part of the leg and are flat on the boot to minimize friction with ground.

BRIEF SUMMARY OF THE INVENTION

None of the aforementioned prior documents refers to the technical problem of the present invention, that is changing the aerodynamic load of the motorcycle in a curve because of an outward movement of the driver's leg. The purpose of the present invention is to devise a motorcycle garment adapted to increase speed when entering a curve on a motorcycle. These and other purposes are achieved by the garment according to the independent claim 1.

In the description below, the following definitions will be used:

"internal leg" is the leg facing the curve;

"lower half-leg" is the leg section comprising knee, shinbone-calf, ankle;

"internal side of leg or of lower half-leg" is the side of the leg or of the lower half-leg facing towards the motorcycle.

The purpose of the present invention is a motorcycle garment comprising a flap positioned on at least one leg of a motorcycle driver and situated on the internal side of the lower half-leg.

Because of the flap, the effects described during the opening of the driver's leg are accentuated, with additional advantages for the driver, who can change the motorcycle's route even more rapidly.

Said device can be positioned in correspondence of the internal side of the leg, that is in correspondence of knees and/or shinbones and/or ankles. In other words, said device can be fixed both on the trousers of a suit and boots, thus becoming a sort of aileron used by the driver, according to his requirements and driving style, by simply opening the internal leg, that is the leg facing the curve.

Therefore, a further purpose of the present invention is a suit and boot provided with said device, which is preferably interchangeable.

An additional purpose of the present invention is a method to make the curve of a motorcycle easier, when the motorcycle driver moves a leg away from the motorcycle, characterized by the fact that it provides for using a flap disposed on the internal side of the lower half-leg.

BRIEF DESCRIPTION OF THE DRAWINGS

For explanatory reasons, the description of the invention continues with reference to attached drawings, which only have an illustrative, not limiting value, wherein.

DETAILED DESCRIPTION OF THE INVENTION

Figure 1:
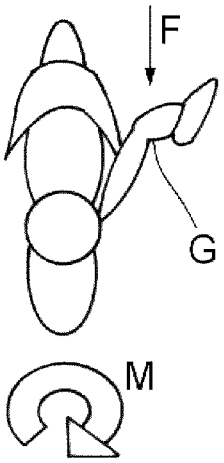
FIG. 1 PRIOR ART
FIG. 1 is a diagrammatic view showing the curving effect of a motorcycle obtained by the driver by moving his leg outwards.
Figure 2:
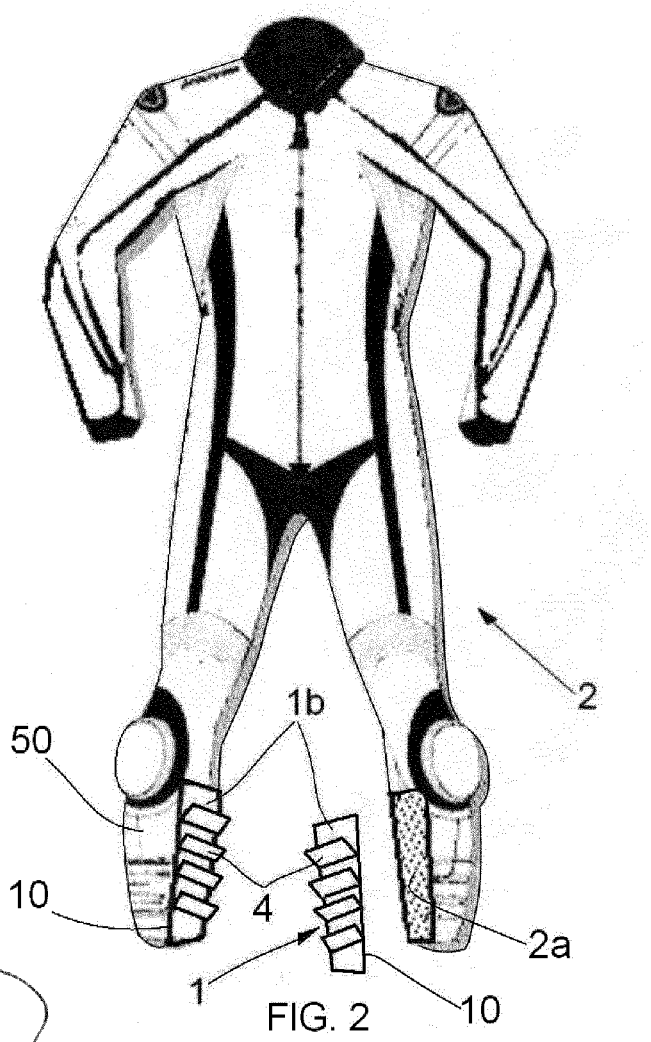
FIG. 2 is a suit according to the present invention, provided with interchangeable flaps on shinbones.
Figure 3:
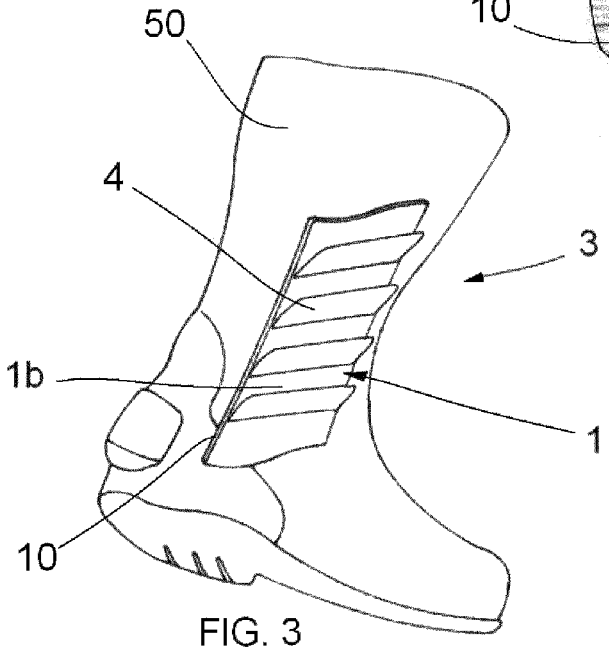
FIG. 3 is a side view of a boot according to the present invention, provided with flap.
Figure 4:
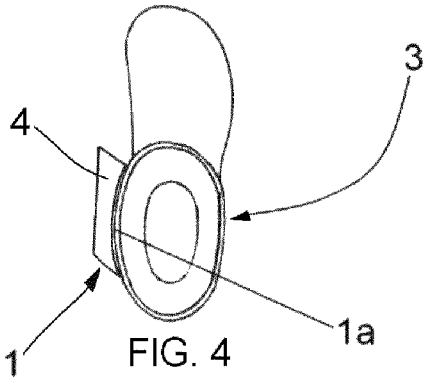
FIG. 4 is a top view of the boot of FIG. 3.

Referring to FIGS. 2 and 3, the garment for motorcycle drivers comprises: leg guards (50) adapted to cover the driver's lower half-leg; and a flap (1) disposed on said leg guards (50), in correspondence of the driver's shinbone, and protruding from the driver's lower half-leg towards the motorcycle in such a way to create higher resistance to air flow generated by the forward travel of motorcycle and increase aerodynamic load of motorcycle, when driver moves his leg away from motorcycle to make curving easier.

In other words, said flap is disposed on the internal side of the driver's lower half-leg, preferably in rear position towards the driver's calf.

The motorcycle garment can be tor example a suit (2) or boot (3). The flap (1) can be mounted on the garment in fixed or removable way.

Referring to FIGS. 2-4, 7 and 8, the flap (1) comprises a body (10) substantially shaped as plate or sheet and at least one wing (4) protruding from said body (10) towards the motorcycle. The body (10) is shaped in such a way to adapt to the internal side of the driver's half-leg, in particular the driver's calf.

Preferably, a plurality of parallel wings (4) is provided. Advantageously, the wings (4) are equally spaced.

The body (10) has a first side (1*a*) adapted to be faced towards the driver's shinbone and a second side (1*b*) adapted to remain visible. The wings (4) protrude from the second side (1*b*) towards the motorcycle.

FIG. 2 shows the suit (2) of the invention provided with said removable flap (1). The first side (1*a*) of the body of the flap is provided with fast fastening-unfastening means adapted to cooperate with complementary fastening-unfastening means (2*a*) provided on the suit (2).

In particular, said fast fastening-unfastening means are provided both on the internal side (1*a*) of the body of the flap and on the suit (2), in correspondence of the internal side of shinbone, that is the side facing the motorcycle. Preferably, said fast fastening-unfastening means consist in Velcro. Alternatively, said fast fastening-unfastening means consist in zippers or snap fasteners or belts.

A further object of the present invention is a suit (2) provided with a pair of fixed flap bodies (1), said flap bodies being an integral part of the suit (2), just like inserts sewn or glued, to the suit (2).

An object of the present invention is also a boot (3) provided with flap body (1) protruding towards the motorcycle, in correspondence of the internal side of shinbone. The flap can be of removable or fixed type, meaning that said flap body (1) is an integral part of the boot (3), such an insert sewn or glued to boot (3).

Figure 5:
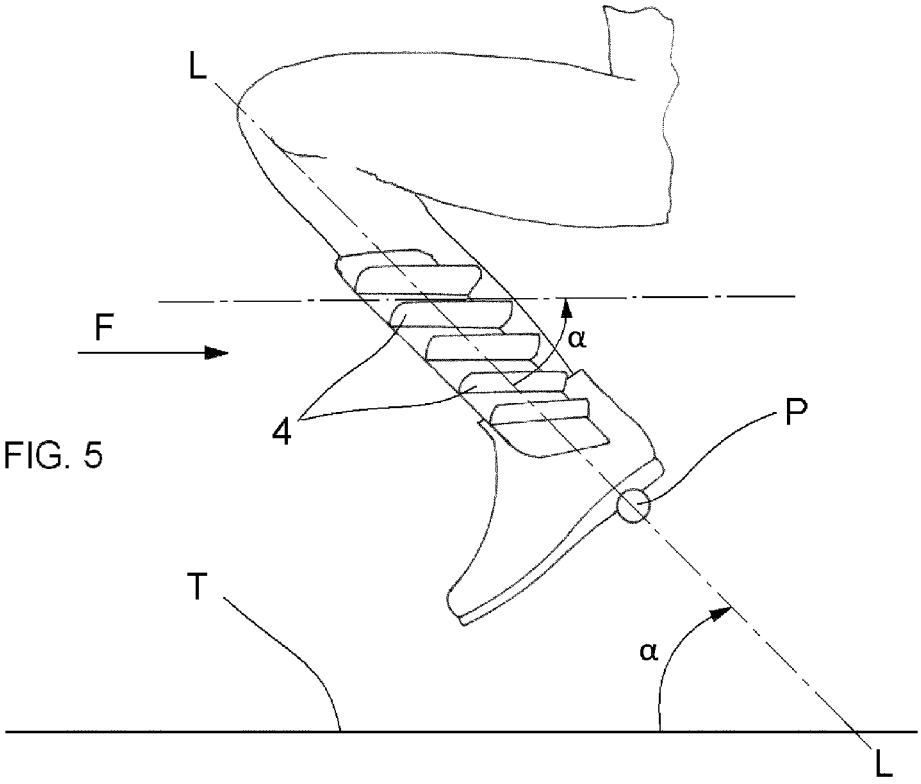
FIGS. 5 and 6 are two diagrammatic views showing the flap applied on the inside of a driver's leg, with the only difference that in FIG. 5 the driver's leg rests on foot rest, whereas in FIG. 6 his leg is raised and extended forwards.

FIG. 5 shows the flap (1) in non-operating position with driver sitting on motorcycle saddle with foot resting on foot rest of motorcycle. Arrow (F) indicates the direction of air current colliding with flap (1) during forward travel of motorcycle; arrow (F) is horizontal and parallel to ground (T).

Figure 7:
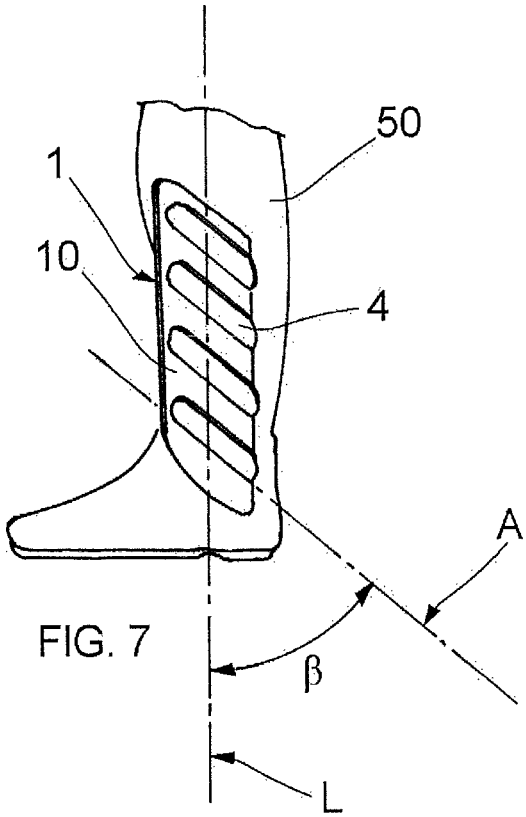
FIG. 7 is a diagrammatic view of a flap applied to a leg of the garment of the invention.

The driver's shinbone has a longitudinal axis (L) coinciding with longitudinal axis of flap (1). When the flap (1) is in non-operating position, the axis (L) of shinbone and consequently the flap (1) joined with shinbone are inclined with respect to surface of ground (T) by an acute angle ($\alpha$). Said angle ($\alpha$) depends on length of driver's legs, driving style and distance between foot rests (P) and motorcycle saddle. Generally, angle ($\alpha$) is comprised between 30 and 60°, preferably 45°, FIG. 7 shows a leg guard (50) with flap (1) worn on driver's leg. When the driver is standing, axis (L) of shinbone is substantially vertical. Said wings (4) extend in transversal direction with respect to the body of the flap and are disposed on the body (10) of flap along an axis (A) inclined downwards by an acute angle ($\beta$) with respect to axis (L) of shinbone. Angle ($\beta$) must be equal to acute angle ($\alpha$).

Going back to FIG. 5, when the flap is in non-operating position, inclined by angle ($\alpha$) with respect to surface of ground (T), each wing (4) is substantially parallel to ground (T) and therefore to direction of air flow (F). Consequently, each wing (4) is disposed in such a way not to oppose air flow (F) and not to generate lift effects.

Figure 6:
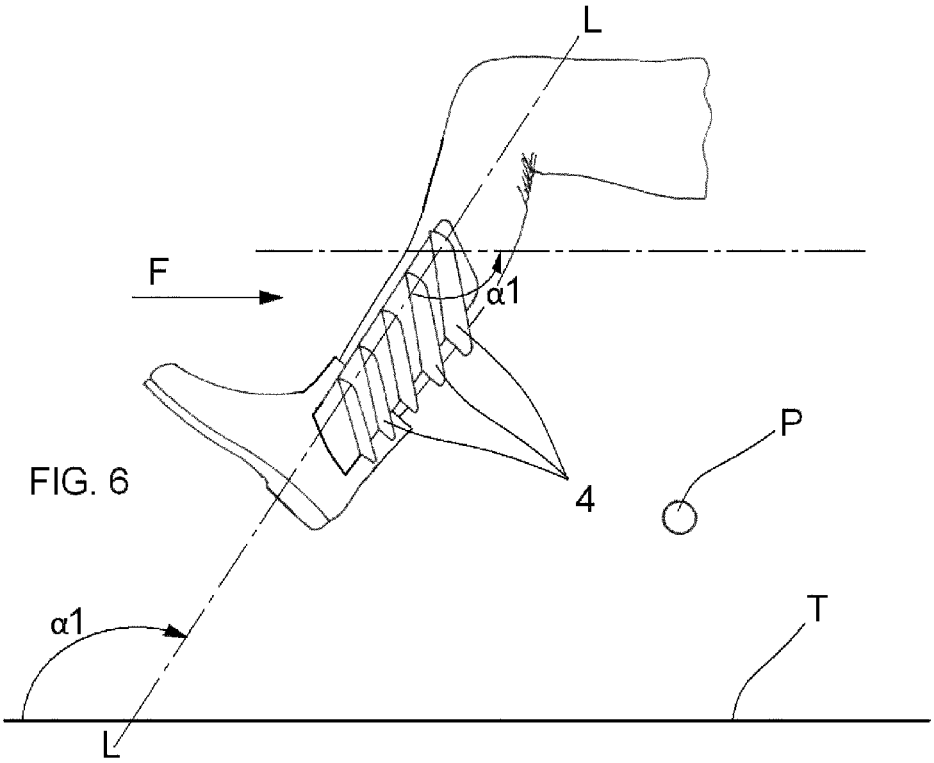

Referring to FIG. 6, as soon as the driver's leg is extended forward towards the outside of the motorcycle, angle between axis (L) of shinbone and ground (T) increases. The figure shows an obtuse angle ($\alpha$1) of approximately 135°. So the wings (4) are no longer parallel to direction of air flow (F). Accordingly, air flow (F) collides with the wings (4), which start generating a higher lift, proportionally to extension of driver's leg. So, lift is proportional to angle between axis (L) of shinbone and surface of ground (T).

Figure 8:
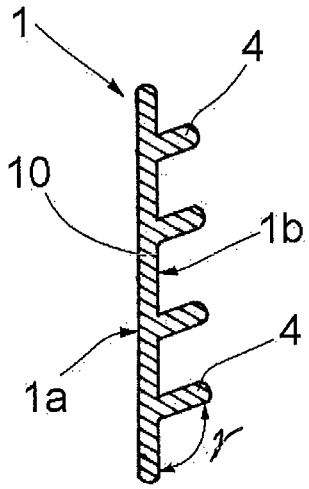
FIG. 8 is a cross-sectional view of a flap of the invention.

Referring to FIG. 8, in order not to generate a too high lift and allow air flow to slide on flap, said wings (4) are disposed according to a plane with upward inclination with respect to plane of body (10), with angle ($\gamma$) slightly higher than 90°.

Figure 9:
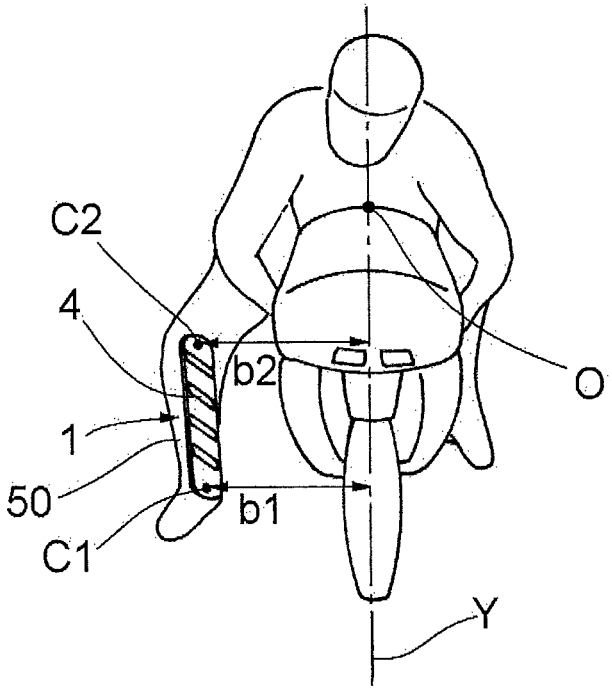
FIG. 9 is a diagrammatic view of a motorcycle with driver wearing the garment of the invention.

Referring to FIG. 9, the flap (1) is disposed on a leg guard (50) between a first point (C1) in correspondence of inside-ankle and a second point. (C2) in correspondence of inside-knee. Numerals (b1 and b2) indicate arms between points (C1, C2) and a vertical plane (Y) passing through center of gravity (O) of motorcycle.

Although (b1) is equal to (b2), it must be considered that distance between (C1) and (O) is higher than distance between (C2) and (O). Consequently, one wing (4) disposed in correspondence of knee (C2) would not give a suitable torque to make the motorcycle curve. Instead, a wing (4) disposed in correspondence of ankle (C1) would give a higher torque.

In any case, according to a preferred embodiment of the invention, the flap (4) provides for a plurality of wings, equally distributed between inside-ankle (C1) and inside-knee (C2) in such a way to increase the torque impose on motorcycle.

The invention claimed is:

1. A garment for a leg of a driver of a motorcycle, the leg having a lower half-leg, an ankle, a knee, a shinbone and a calf, the garment comprising:

an internal side facing the motorcycle;

at least one leg guard attached to the garment and adapted to cover the leg at least partially; and at least one flap disposed on the at least one leg guard so as to correspond to the lower half-leg of the driver, the at least one flap on the internal side of the garment and adapted to protrude from the lower half-leg toward the motorcycle so as to increase resistance to air flow caused by a forward travel of the motorcycle and to increase aerodynamic load on the motorcycle when the driver moves the leg away from the motorcycle, the at least one flap comprising a body of a plate shape or of a sheet shape and having at least one wing protruding from said body and adapted to extend toward the motorcycle, the at least one wing being disposed along an axis inclined at an acute angle with respect to an axis of the shinbone of the driver, said acute angle being between 30° and 60° and adapted to be located between an inside of the ankle and an internal surface of the knee, said at least one wing disposed along a plane inclined upwardly at an angle of greater than 90° with respect to said body; and said at least one wing comprising a plurality of parallel wings.

2. The garment of claim 1, the at least one flap adapted to be positioned on the internal side of the garment corresponding to the lower half-leg in a rear position toward the calf of the driver.

3. The garment of claim 1, said body being shaped so as to adapt to the calf of the driver.

4. The garment of claim 1, said plurality of parallel wings being in equally-spaced relationship.

5. The garment of claim 1, said at least one flap having a fastener attachable and detachable to another fastener on said at least one leg guard.

6. The garment of claim 5, said fastener of said at least one flap being a hook-and-loop fastener, said fastener of said at least one leg guard being a complementary hook-and-loop fastener.

7. The garment of claim 5, the fasteners of said at least one flap and said at least one leg guard being a zipper.

8. The garment of claim 5, the fasteners of said at least one flap and said at least one leg guard comprising at least one belt.

9. A method for enhancing an ability to curve a motorcycle, the method comprising the steps of:

applying of a flap onto a leg guard of a motorcycle garment, said leg guard positioned onto a lower half-leg of a leg of a driver of the motorcycle, said flap protruding from the lower half-leg of the driver toward the motorcycle;

extending the leg of the driver outwardly from the motorcycle such that an air flow generated by a forward travel of the motorcycle impacts against said flap so as to increase resistance to the air flow generated by the forward travel of the motorcycle so as to increase an aerodynamic load on the motorcycle, and curving the motorcycle by the increasing of the resistance to the air flow generated by the forward travel of the motorcycle and the increasing of the aerodynamic load on the motorcycle generated by said flap.

10. The garment of claim 1, wherein the garment is a suit.

11. The garment of claim 1, wherein the garment is a boot.

* * * * *